US010856700B2

(12) United States Patent
Darcie

(10) Patent No.: US 10,856,700 B2
(45) Date of Patent: Dec. 8, 2020

(54) WALK-IN BATH AND SHOWER COMBINATION

(71) Applicant: Kim Darcie, Rochester, NY (US)

(72) Inventor: Kim Darcie, Rochester, NY (US)

( * ) Notice: Subject to any disclaimer, the term of this patent is extended or adjusted under 35 U.S.C. 154(b) by 107 days.

(21) Appl. No.: 16/202,319

(22) Filed: Nov. 28, 2018

(65) Prior Publication Data

US 2020/0163493 A1 May 28, 2020

(51) Int. Cl.
*A47K 3/00* (2006.01)
*A47K 3/28* (2006.01)

(52) U.S. Cl.
CPC ..... *A47K 3/006* (2013.01); *A47K 3/28* (2013.01); *A47K 3/283* (2013.01)

(58) Field of Classification Search
CPC . A47K 3/006; A47K 3/04; A47K 3/08; A47K 3/28; A47K 3/40; A47K 3/405; A47K 3/283; A47K 3/284; A47K 4/00; A47K 3/022; E03C 1/01
USPC ..... 4/555, 604, 612, 614
See application file for complete search history.

(56) References Cited

U.S. PATENT DOCUMENTS 3,060,453 A * 10/1962 Swan ..... A47K 3/283 52/34
3,371,354 A * 3/1968 Hayslett ..... A47K 3/006 4/556
3,604,018 A * 9/1971 Moran ..... A47K 3/006 4/556
3,955,219 A * 5/1976 Finch ..... A47K 3/006 4/552
4,215,444 A * 8/1980 Brown ..... A47K 3/28 4/612
4,899,402 A * 2/1990 Maynard ..... A47K 1/04 4/604
4,928,329 A * 5/1990 Palmeri ..... A47K 4/00 4/552
2011/0056013 A1* 3/2011 Seymour ..... A61G 7/1003 4/560.1
2014/0201900 A1* 7/2014 Torres ..... A47K 3/006 4/556
2014/0259372 A1* 9/2014 Beard ..... B64D 11/00 4/614

FOREIGN PATENT DOCUMENTS

EP 0344588 * 12/1989 ..... A47K 3/283

* cited by examiner

*Primary Examiner* — J C Jacyna
(74) *Attorney, Agent, or Firm* — Kristin Grant; Grant Attorneys at Law PLLC

(57) ABSTRACT

A walk-in bath and shower combination, comprising a rear wall with a far corner and a near corner, a front wall with a far corner and a near corner, the front wall parallel to the rear wall and comprising of a water release apparatus, a right wall extending between the rear wall and the front wall and meeting the rear wall and the front wall at their respective far corners, a tub wall parallel to the right wall, the tub wall extending from the near corner of the front wall and ending at a dip point, a main tub floor extending from the rear wall to the front wall, the main tub floor comprising of a drain and a two-way slope, and a vertical dip at the dip point extending horizontally from the tub wall to the right wall.

9 Claims, 3 Drawing Sheets

WALK-IN BATH AND SHOWER COMBINATION

BACKGROUND

Field of Invention

The present invention relates generally to bathtubs, and more specifically to a walk-in bath and shower combination with a sloping floor.

Related Art

Conventional showers require standing for extended periods. Conventional bathtubs have one or more raised side walls requiring an individual to step over a wall in order to enter the tub. Walk-in bath tubs are well known in the art and are useful for the elderly or for persons with mobility issues. They provide a safer and more practical option where the use of a conventional shower or conventional bathtub may prove difficult. Walk-in tubs typically feature doors or similar entry means allowing a user to walk-in and close the tub behind them. For example, U.S. Pat. No. 7,299,509B1 discloses a side door for a walk-in bathtub, U.S. Pat. No. 3,371,354A discloses a walk-in bathtub with a door which remains closed when the tub is filled with water, and U.S. Pat. No. D622363S1 discloses a walk-in bathtub with a side door.

Many showers feature sloping floors. The purpose of the slope is to ensure that water is adequately reaching the drain and not forming puddles which remain on the shower floor for extended periods after use. Typically, the angle of the slope is very slight and barely noticeable to a user and the slope is directed towards the drain regardless of whether the drain is in the center, at one end, or to the side of the shower floor.

While a bathtub with a door has become the common practical option for the elderly or persons with mobility issues, the present invention discloses an alternate option providing similar convenience, safety, and practicality. The present invention discloses a walk-in bath and shower combination featuring a walk-in area separated from a main tub area, a two-way sloping floor and a dip for preventing backflow of water.

SUMMARY OF INVENTION

It is to be understood that the phraseology and terminology employed herein are for the purpose of the description and should not be regarded as limiting.

The present invention is directed to a walk-in bath and shower combination, comprising a rear wall with a far corner and a near corner, a front wall with a far corner and a near corner, the front wall parallel to the rear wall wherein the horizontal length of the front wall is shorter than the horizontal length of the rear wall, the front wall comprising of a water release apparatus. A right wall extending between the rear wall and the front wall and meeting the rear wall and the front wall at their respective far corners, a left wall parallel to the right wall, and a main tub floor extending from the rear wall to the front wall, the main tub floor comprising of a drain and a two-way slope.

The invention further comprises of a tub wall at a location between the right wall and the left wall, wherein the tub wall is parallel to both the right wall and the left wall and separates the main tub floor from a walk-in floor, the tub wall extending from the near corner of the front wall and ending at a dip point, the walk-in floor comprising of an area between the left wall and the tub wall, and a vertical dip at the dip point extending horizontally from the tub wall to the right wall. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
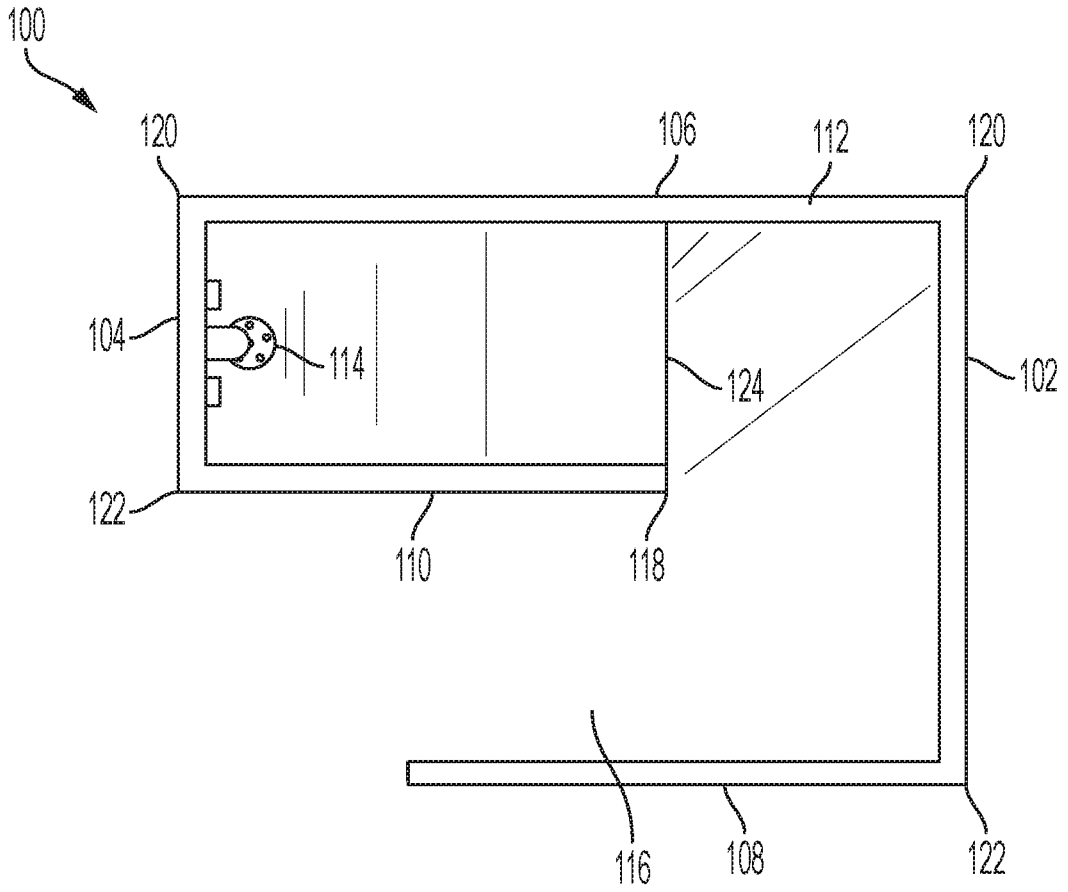
FIG. 1 is top view of a walk-in bath and shower combination according to an embodiment of the present invention.
Figure 2:
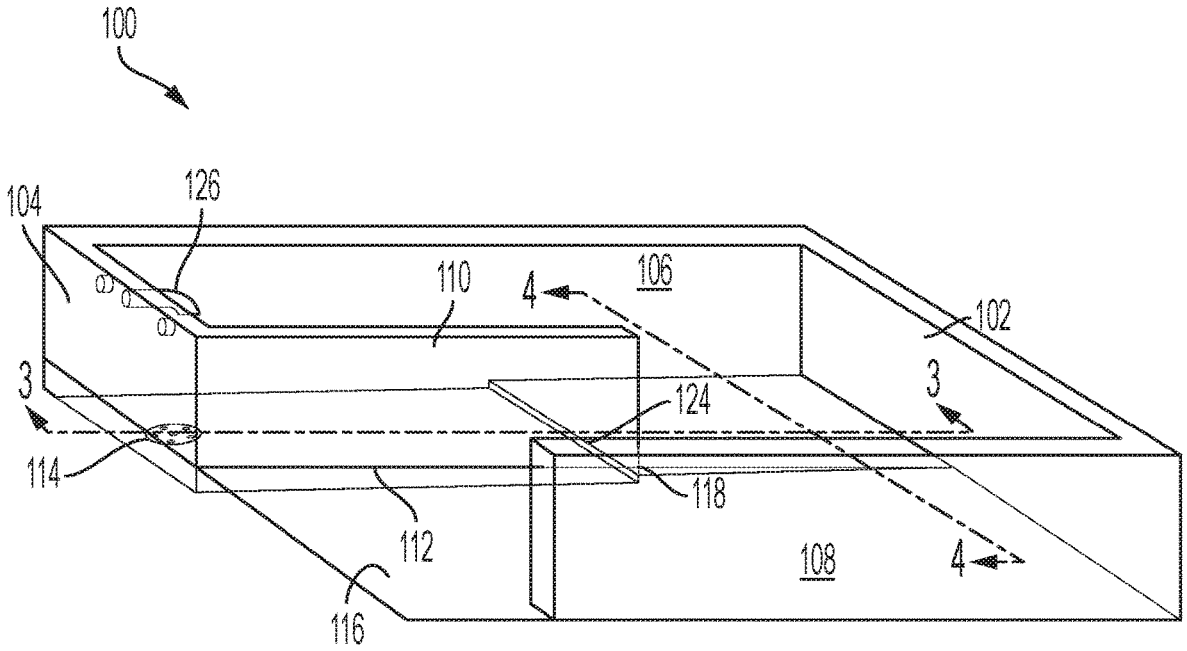
FIG. 2 is a side perspective view of the tub of a walk-in bath and shower combination according to an embodiment of the present invention.
Figure 3:
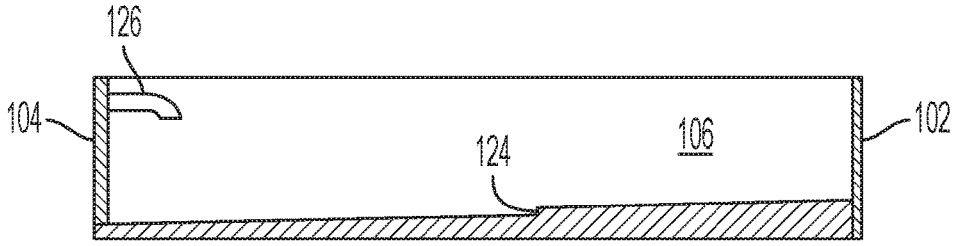
FIG. 3 is a cross section view taken through 3-3 of FIG. 2.
Figure 4:
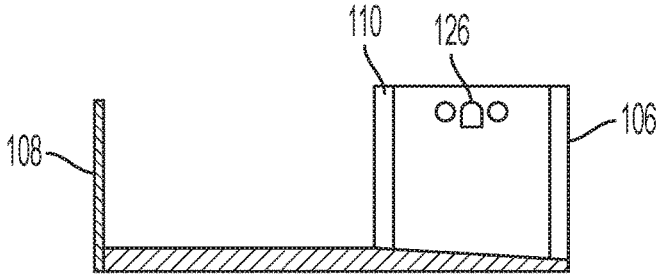
FIG. 4 is a cross section view taken through 4-4 of FIG. 2.

Referring now to the figures where similar reference characters denote similar elements throughout the figures, FIGS. 1, 2, 3 and 4 show top, side perspective, and cross section views, respectively, of a walk-in bath and shower combination 100 comprising of a rear wall 102 having a far corner 120 and a near corner 122, a front wall 104 having a far corner 120 and a near corner 122, the front wall 104 parallel to the rear wall 102, the front wall 104 with a horizontal length which is shorter than the horizontal length of the rear wall 102, a right wall 106 extending between the rear wall 102 and the front wall 104 and meeting both the front wall 104 and the rear wall 102 at their far corners 120, a left wall 108 extending from the near corner 122 of the rear wall 102 and being parallel to the right wall 106. The front wall 104 also comprising of a water release apparatus 126 such as a shower head, bathtub spout, or a combination thereof. In an embodiment of the present invention, the left wall 108 has a horizontal length which is shorter than the horizontal length of the right wall 106.

The invention further comprising of a main tub floor 112, extending from the rear wall 102 to the front wall 104, the main tub floor 112 comprising of a drain 114 and a two-way slope. The two-way slope for allowing water to reach the drain 114 and preventing puddles from remaining on the main tub floor 112 for extended periods after use. A tub wall 110 located between the right wall 106 and the left wall 108, wherein the tub wall 110 is parallel to both the right wall 106 and the left wall 108 separating the main tub floor 112 from a walk-in floor 116. The walk-in floor 116 comprising of an area between the left wall 108 and the tub wall 110. The tub wall 110 extending from the near corner 122 of the front wall 104 and ending at a dip point 118. The dip point 118 preferably located at a distance which is 2 feet to 3 feet away from the rear wall 102. A dip 124 starting at the dip point 118 and extending horizontally from the tub wall 110 to the right wall 106. In a preferred embodiment the dip 124 is a vertical dip which is 1 inch deep or less. The dip 124 preventing water from flowing backwards into the walk-in floor 116 when the main tub floor 112 is filled with water during seated use.

The drain 114 is proximal to the front wall 104 and the two-way slope is a slope downwards starting at the rear wall 102 and ending at the front wall 104 and to the right starting at the tub wall 110 and ending at the right wall 106. In a preferred embodiment the two-way slope is at an angle of no more than 10 degrees in either direction.

While the dimensions of the present invention can be altered according to custom specifications, in a preferred embodiment of the present invention the front wall 104 has a horizontal length of 2 feet and a height of 2 feet, the rear wall 102 has a horizontal length of 5 feet, the right wall 106 has a horizontal length of 7 feet, the tub wall 110 has a horizontal length of 5 feet and a height of 1 foot, and the left wall 108 has a horizontal length of 5 feet and a height of 1 foot. The tub wall 110 and the left wall 116 can each have glass blocks or similar transparent material placed vertically on top. The glass blocks or similar transparent material prevent water from splashing outside of the main tub floor 112 while still providing sufficient light to shine throughout the walk-in bath and shower combination 100.

Figure 5:
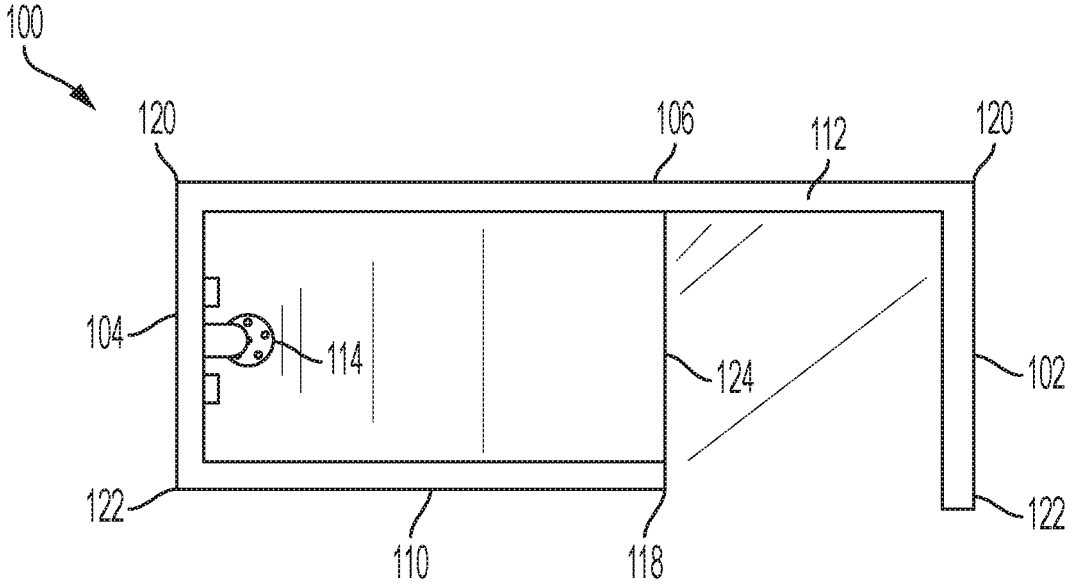
FIG. 5 is a top view of a walk-in bath and shower combination according to an embodiment of the present invention.

In an embodiment of the present invention according to FIG. 5, the of a walk-in bath and shower combination 100 comprises of a rear wall 102 having a far corner 120 and a near corner 122, a front wall 104 having a far corner 120 and a near corner 122, the front wall 104 parallel to the rear wall 102, a right wall 106 extending between the rear wall 102 and the front wall 104 and meeting both the front wall 104 and the rear wall 102 at their far corners 120, The front wall also comprising of a water release apparatus 126 such as a shower head, bathtub spout, or a combination. The invention further comprising of a main tub floor 112, extending from the rear wall 102 to the front wall 104, the main tub floor 112 comprising of a drain 114 and a two-way slope. A tub wall 110 located parallel to the right wall 106, the tub wall 110 extending from the near corner 122 of the front wall 104 and ending at a dip point 118. The dip point 118 preferably located at a distance which is 2 feet to 3 feet away from the rear wall 102. A dip 124 starting at the dip point 118 and extending horizontally from the tub wall 110 to the right wall 106. In a preferred embodiment the dip is a vertical dip which is 1 inch deep or less. The drain 114 is proximal to the front wall 104 and the two-way slope is a slope downwards starting at the rear wall 102 and ending at the front wall 104 and to the right starting at the tub wall 110 and ending at the right wall 106. In a preferred embodiment the two-way slope is at an angle of no more than 10 degrees in either direction.

What is claimed is:

1. A walk-in bath and shower combination, comprising:

a. a rear wall with a far corner and a near corner;

b. a front wall with a far corner and a near corner, the front wall parallel to the rear wall and comprising of a water release apparatus;

c. a right wall extending between the rear wall and the front wall and meeting the rear wall and the front wall at their respective far corners;

d. a tub wall parallel to the right wall, the tub wall extending from the near corner of the front wall and ending at a dip point;

e. a main tub floor extending from the rear wall to the front wall, the main tub floor comprising of:

i. a drain; and ii. a two-way slope, wherein the two-way slope of the main tub floor is downward starting from the rear wall and ending at the front wall and towards the right starting at the tub wall and ending at the right wall; and f. a vertical dip at the dip point extending horizontally from the tub wall to the right wall.

2. The walk-in bath and shower combination of claim 1, wherein the dip point is located at a distance which is 2 feet to 3 feet away from the rear wall.

3. The walk-in bath and shower combination of claim 1, wherein the drain is located proximal to the front wall.

4. The walk-in bath and shower combination of claim 1, wherein the dip has a height of 1 inch or less.

5. The walk-in bath and shower combination of claim 1, wherein the two-way slope is at an angle of no more than 10 degrees in either direction.

6. A walk-in bath and shower combination, comprising:

a. a rear wall far corner and a near corner;

b. a front wall with a far corner and a near corner, the front wall parallel to the rear wall wherein the horizontal length of the front wall is shorter than the horizontal length of the rear wall, the front wall comprising of a water release apparatus;

c. a right wall extending between the rear wall and the front wall and meeting the rear wall and the front wall at their respective far corners;

d. a left wall parallel to the right wall wherein the left wall extends from the near corner of the rear wall and has a horizontal length which is shorter than the horizontal length of the right wall;

e. a main tub floor extending from the rear wall to the front wall, the main tub floor comprising of:

i. a drain; and ii. a two-way slope, wherein the two-way slope of the main tub floor is downward starting from the rear wall and ending at the front wall and towards the right starting at the tub wall and ending at the right wall;

f. A tub wall at a location between the right wall and the left wall, wherein the tub wall is parallel to both the right wall and the left wall and separates the main tub floor from a walk-in floor, the tub wall extending from the near corner of the front wall and ending at a dip point, the walk-in floor comprising of an area between the left wall and the tub wall; and g. a vertical dip at the dip point extending horizontally from the tub wall to the right wall.

7. The walk-in bath and shower combination of claim 6, wherein the drain is located proximal to the front wall.

8. The walk-in bath and shower combination of claim 6, wherein the dip has a height of 1 inch or less.

9. The walk-in bath and shower combination of claim 6, wherein the two-way slope is at an angle of no more than 10 degrees in either direction.

* * * * *